US005970637A

United States Patent [19]

Mohan et al.

[11] Patent Number: 5,970,637

[45] Date of Patent: Oct. 26, 1999

[54] AUTOMATIC SHIRT PRESSING APPARATUS INCLUDING A VACUUM SYSTEM AND ASSOCIATED METHOD

[75] Inventors: Manohar Mohan, Cincinnati; Sarupinder Gill, Westchester, both of Ohio

[73] Assignee: American Laundry Machinery, Inc., Cincinnati, Ohio

[21] Appl. No.: 09/086,484

[22] Filed: May 29, 1998

[51] Int. Cl.[6] ..... D06F 71/20

[52] U.S. Cl. ..... 38/22; 223/70; 38/7; 38/14

[58] Field of Search ..... 38/1 R, 4, 6, 7, 38/14, 18, 21, 22; 8/149.3; 68/5 R; 137/340, 384, 878, 615; 285/23, 41, 33, 80, 98, 99, 9.2, 11, 108, 113, 383

[56] References Cited

U.S. PATENT DOCUMENTS

| | | | |
|---|---|---|---|
| 2,241,373 | 5/1941 | Rawlinson et al. . | |
| 2,551,209 | 5/1951 | Glover, Sr. et al. | 223/70 X |
| 3,070,268 | 12/1962 | Carpenter . | |
| 3,094,797 | 6/1963 | Turner et al. | 38/22 |
| 3,174,662 | 3/1965 | Kannegiesser et al. . | |
| 3,823,854 | 7/1974 | Everett | 223/73 |
| 4,715,404 | 12/1987 | Fusy | 137/615 |
| 5,065,535 | 11/1991 | Gill et al. . | |
| 5,526,558 | 6/1996 | Caley, Sr. | 285/23 X |

*Primary Examiner*—Ismael Izaguirre

*Attorney, Agent, or Firm*—Bacon & Thomas, PLLC

[57] ABSTRACT

An automatic shirt pressing apparatus includes at least a loading station, a pressing station and a movable support upon which a plurality of shirt receiving bucks are mounted for movement between the loading and pressing stations. A buck vacuum supply arrangement is associated with each of the bucks. A movable vacuum supply tube is arranged to successively be removably connected to the buck vacuum arrangement of each of the bucks when the buck located at the loading station, to travel with each of the bucks to a pressing station while remaining connected thereto and to be disconnected from the buck vacuum arrangement once a pressing operation is initiated. A method of pressing a shirt using such an automatic shirt pressing apparatus is also described. The method includes the steps of dressing a shirt on a respective buck located at a loading station, supplying a vacuum negative pressure to a vacuum arrangement of the respective buck located at the loading station to hold at least a front tail of the shirt against the respective buck, maintaining the vacuum negative pressure supplied to the vacuum arrangement of the respective buck continuously and uninterruptedly while moving the respective buck from the loading station to a pressing station, initiating pressing of the shirt against the respective buck, releasing vacuum negative pressure supplied to the vacuum arrangement of the respective buck once the pressing of the shirt has commenced, and returning the vacuum source to the loading station independently of the buck located in the pressing station.

13 Claims, 6 Drawing Sheets

AUTOMATIC SHIRT PRESSING APPARATUS INCLUDING A VACUUM SYSTEM AND ASSOCIATED METHOD

BACKGROUND OF THE INVENTION

1. Field of the Invention

The present invention relates to an automatic shirt pressing apparatus which includes a vacuum system. The present invention also relates to a method for using such an apparatus.

2. Description of the Related Art

Various apparatus and methods are known for pressing garments, specifically shirts. For example, U.S. Pat. Nos. 2,241,373, 3,070,268; 3,174,662 and 5,065,535 disclose shirt pressing machines which rotate a plurality of bucks between at least a dressing or loading station and a pressing station. Above-mentioned Pat. No. 5,065,535 is commonly owned with and the inventors are the same as the inventors of this invention. This patent discloses a basic indexing system similar to the one described herein.

It is known that fully dressing or buttoning the front of a shirt to be pressed is too time consuming and therefore impractical. Thus, various means have been developed to hold the front tail of a shirt against the buck for transport to the pressing station and for subsequent pressing of the shirt. Typically, the means are either a rod or an elongated plate which clamps the front tail of the shirt against the buck. These known devices, however, suffer from the disadvantage that when the shirt is pressed in the pressing station, an imprint of the rod or plate is pressed into the front tail of the shirt. Removal of the rod or plate just prior to pressing is not practical as the shirt may become displaced on the buck before pressing. The displacement of the shirt results in improper pressing of the shirt in the form of unwanted folds or wrinkles.

To remedy the disadvantage of obtaining a pressed shirt with an impression of the bar or plate along the front tail of the shirt, an automatic shirt pressing apparatus including a vacuum system for holding the front tail of the shirt against the buck has been developed. This known vacuum system operates using a two chamber vacuum system to apply a vacuum to hold the shirt against the buck at both the loading station and the pressing station. However, during the transfer of the shirt from the loading station to the pressing station, the vacuum is released for a brief moment and the shirt is released momentarily. When the vacuum is reestablished, the shirt may not be in its original position and wrinkles or unwanted folds may be pressed into the shirt as a result. Thus, while this known vacuum system avoids leaving the impression of a holding means in the front tail of the shirt, it does not provide satisfactory results.

SUMMARY OF THE INVENTION

The present invention aims towards an automatic shirt pressing apparatus including a buck vacuum system for holding at least the front tail of a shirt in place which avoids the above-mentioned and other disadvantages. The present invention also aims towards a method for pressing a shirt using such an automatic shirt pressing machine which avoids the disadvantages of the prior art.

To this end, the present invention provides an automatic shirt pressing apparatus having at least a loading station and a pressing station, possibly with a third unloading station. The apparatus includes a movable support on which a buck or bucks are mounted for movement. A buck vacuum arrangement is associated with each of the bucks. The apparatus also includes a vacuum supply tube which successively connects to the buck vacuum arrangement of each of the bucks when they are located at the loading station, travels with each of the bucks to the pressing station while remaining connected thereto, disconnects from the buck vacuum arrangement of each of the bucks once a pressing operation has commenced, and returns to the loading station to connect with the next succeeding buck.

According to a preferred embodiment, the support holds three bucks and is rotatable about an axis. The apparatus also includes an indexing device to which the vacuum supply tube is connected. The indexing device is also mounted for rotation about the axis of the rotatable support and successively moves the vacuum supply tube connected with a buck from the loading station to the pressing station and returns the vacuum supply tube to the loading station independently of the buck located at the pressing station.

Also according to the preferred embodiment, the vacuum supply tube is connected to the indexing device by a lever arm which is pivotably mounted thereon. The apparatus may also include: a biasing element which resiliently biases the lever arm such that the vacuum supply tube is in a normally lowered position; a lifting pin which when actuated pushes against the lever arm opposite the biasing element such that the vacuum supply tube is in a raised position; and a lifting pin cylinder which actuates the lifting pin to push against the lever arm. According to this embodiment, the raised position of the vacuum supply tube corresponds to a position at which the vacuum supply tube is connected to a buck vacuum arrangement of one of the bucks from below the buck and the lowered position of the vacuum supply tube corresponds to a position in which the vacuum supply tube is disconnected from the buck vacuum arrangement of any of the bucks.

According to the preferred embodiment, the apparatus includes an indexing mechanism connected to the indexing device which is engageable with the rotatable support for indexing the rotatable support.

According to a preferred embodiment, the indexing mechanism includes: a plurality of indexing pin openings in the rotatable support; an indexing pin mounted on the indexing device which is engagable with the indexing pin openings; an indexing pin actuator mounted on the indexing device which actuates the indexing pin for engagement with the indexing pin openings; and an indexing actuator connected to the indexing device which moves the indexing device between a first position and a second position. The indexing actuator thus moves the rotatable support from the first position to the second position via engagement of the indexing pin with the indexing pin openings.

According to a preferred embodiment, the indexing mechanism also includes an auxiliary actuator for properly positioning the indexing pin relative to one of the indexing pin holes at the first position. The auxiliary actuator may be controlled by one or more limit switches and a control system in accordance with known principles.

The method of pressing a shirt according to the present invention includes the steps of: dressing a shirt on a respective buck located at a loading station; supplying a vacuum negative pressure to a vacuum arrangement of the respective buck located at the loading station to hold at least a front tail of the shirt against the respective buck; continuously and uninterruptedly maintaining the vacuum negative pressure supplied to the vacuum arrangement of the respective buck while moving the respective buck from the loading station to a pressing station; initiating pressing of the shirt against the respective buck; and releasing the vacuum negative pressure supplied to the vacuum arrangement of the respective buck once the pressing of the shirt has commenced. The method also includes the step of returning the vacuum tube from the pressing station to the loading station independently of the rotatable support and the buck located in the pressing system.

Other features of the automatic shirt pressing apparatus and the method of pressing a shirt according to the present invention will become evident upon reviewing the detailed description which follows along with the accompanying drawings.

BRIEF DESCRIPTION OF THE DRAWINGS

In order to better explain the characteristics of the invention, the following description of preferred embodiments of an automatic shirt pressing apparatus including a vacuum system and a method of pressing a shirt are provided, as examples only without restricting the invention in anyway, with reference to the accompanying drawings, in which:

FIG. 6 is a partial view of an indexing mechanism as seen from section line 6—6 in FIG. 4;

DETAILED DESCRIPTION OF THE PREFERRED EMBODIMENTS

Figure 1:
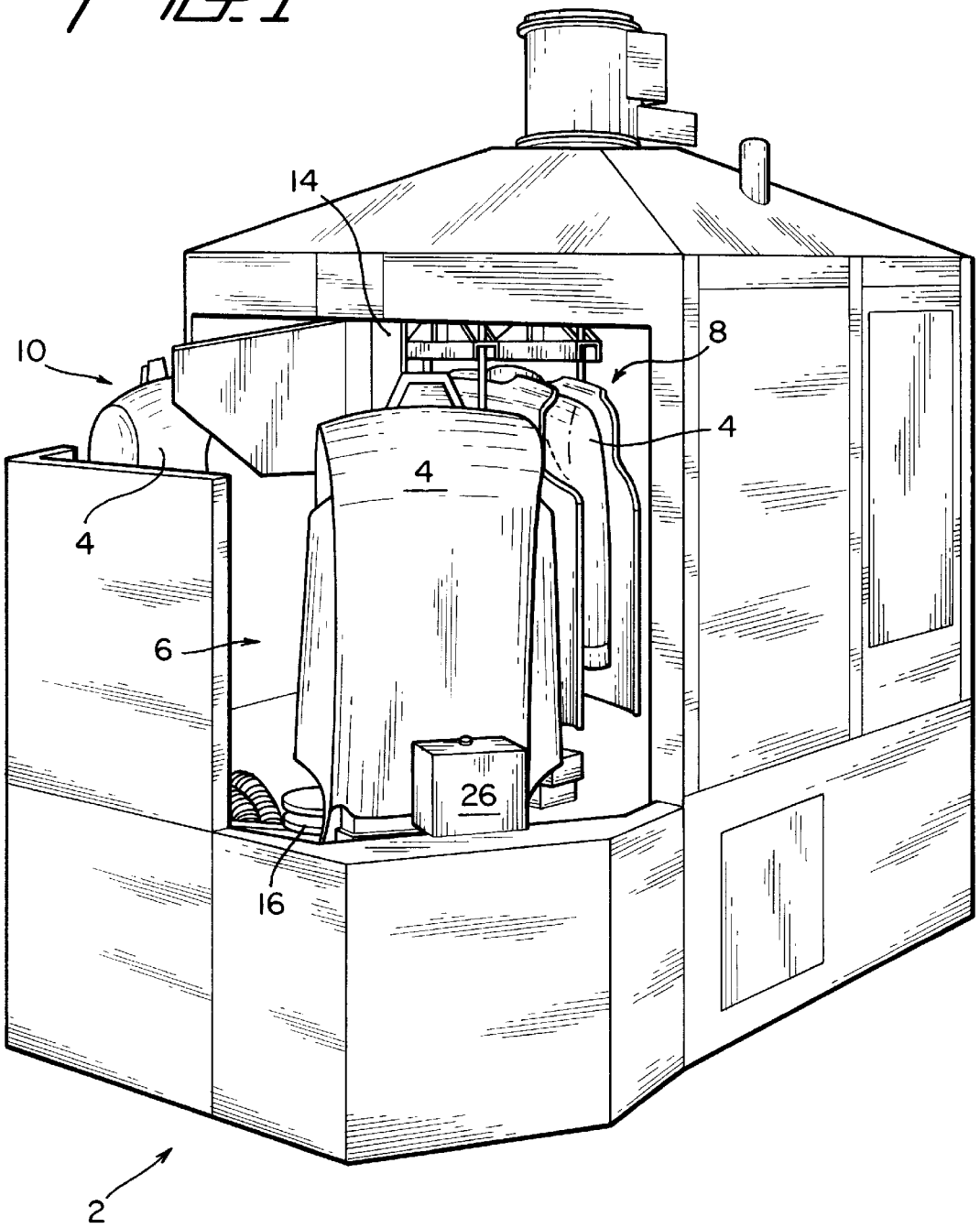
FIG. 1 is a perspective view of an automatic shirt pressing apparatus according to the pressing invention.
Figure 2:
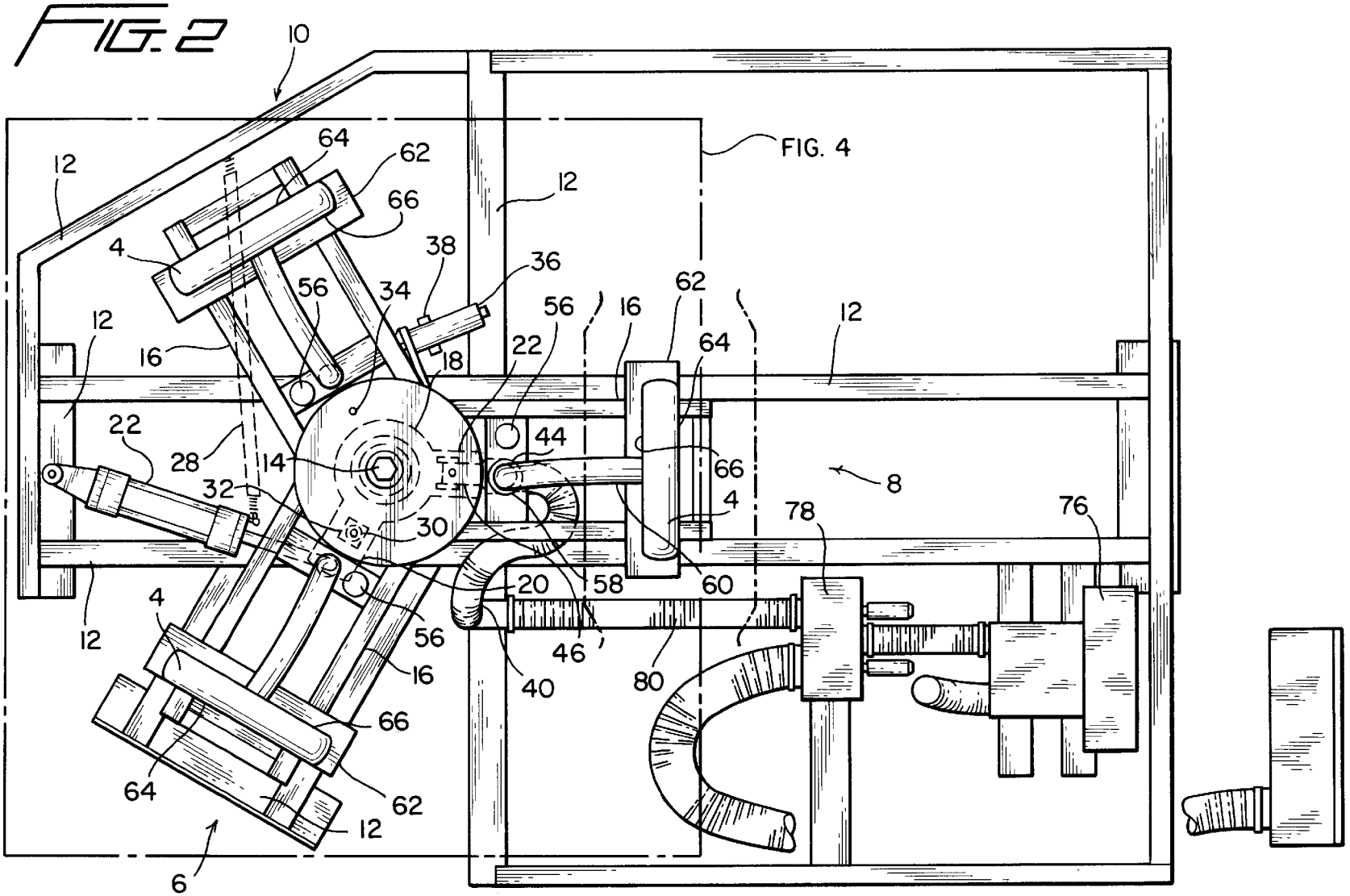
FIG. 2 is a top plan view of the automatic shirt pressing apparatus according to the present invention.

An industrial shirt press or automatic shirt pressing apparatus 2 having a plurality of shirt receiving bucks 4 which are cyclically movable through a series of stations including a dressing or loading station 6, a pressing station 8 and optionally an unloading station 10 is shown in FIG. 1. As shown in FIG. 2, automatic shirt pressing apparatus 2 includes a frame 12 to which the other elements of the apparatus may be mounted. In the preferred embodiment shown, a vertical central shaft 14 is mounted on a lower portion of frame 12 as well as connected to an upper portion of frame 12.

Figure 3:
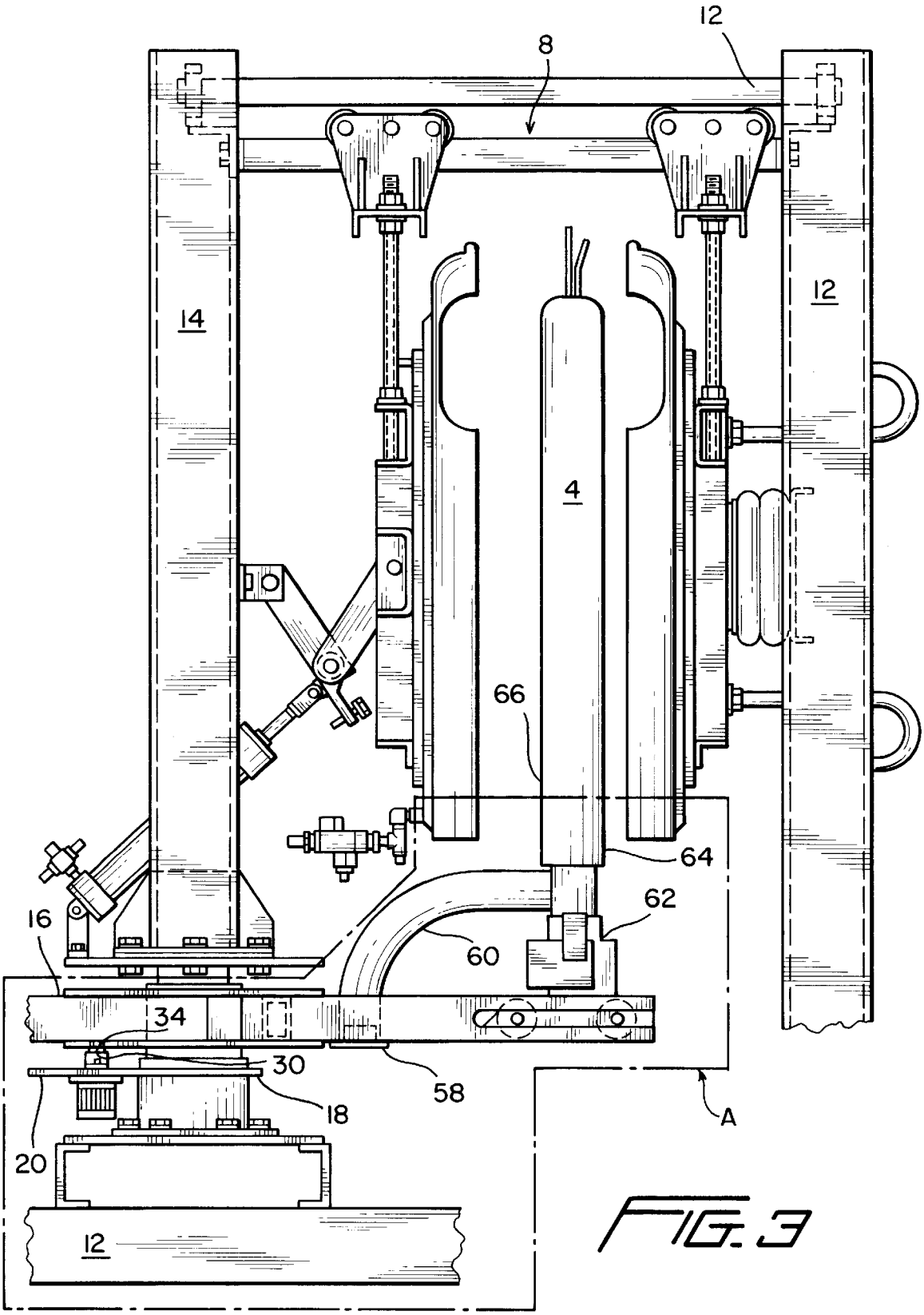
FIG. 3 is a side elevation view of a portion of the automatic shirt pressing apparatus including the pressing station.
Figure 4:
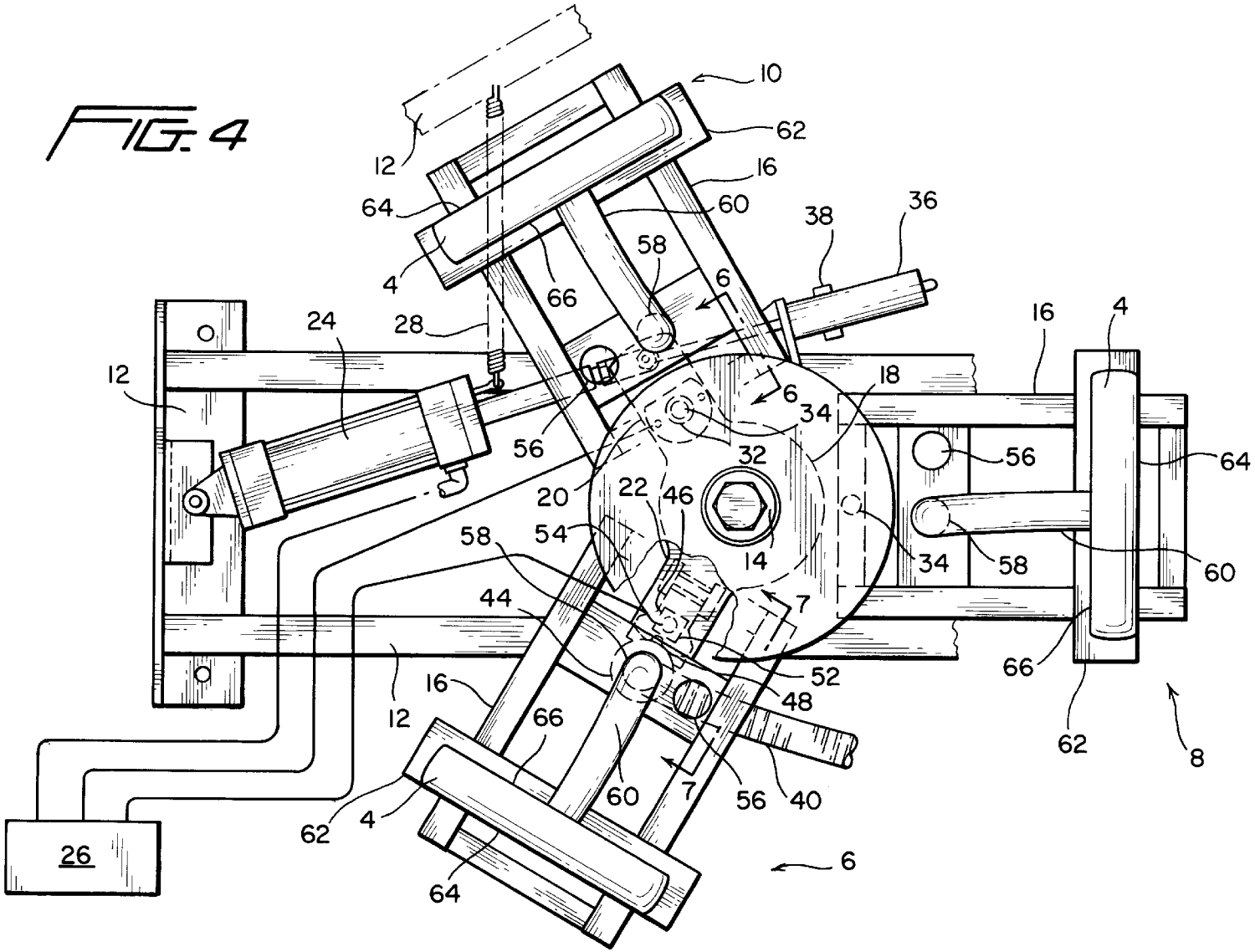
FIG. 4 is an enlarged top plan view of the boxed area shown as A in FIG. 2.
Figure 5:
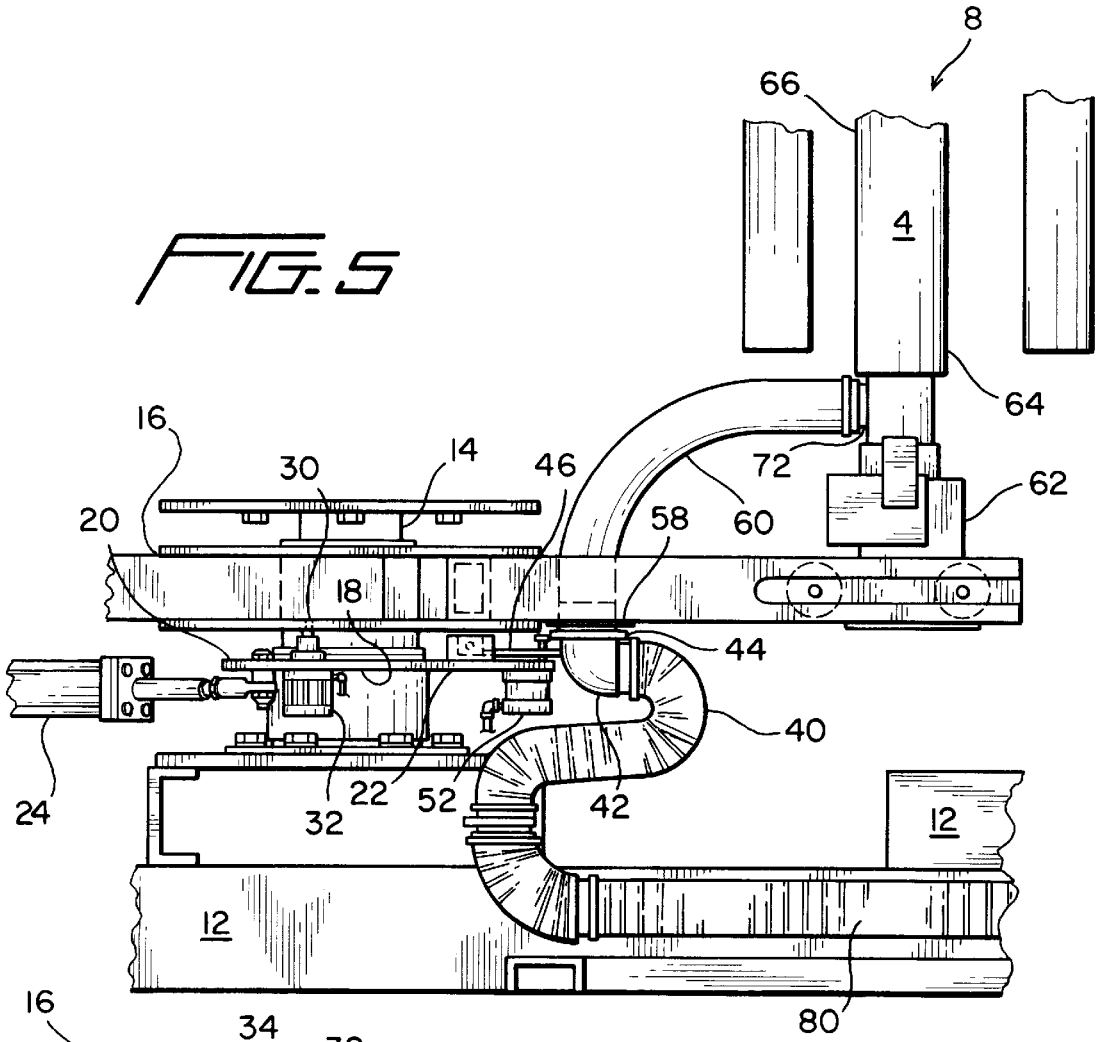
FIG. 5 is an enlarged side elevation view of the boxed area shown as A in FIG. 3.
Figure 8:
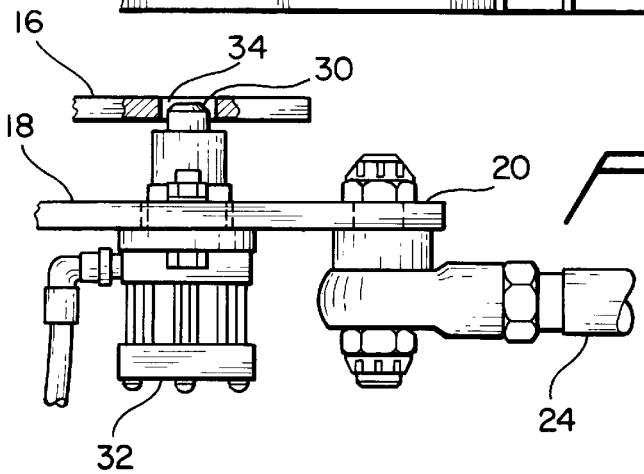
FIG. 8*a* is a rear elevational view of a buck including a vacuum arrangement according to the present invention.
FIG. 8*b* is a sectional side view taken along section line 8*b*—8*b* in FIG. 8*a*.

As shown in FIGS. 2 and 3, as well as in FIGS. 4 and 5 in more detail, a rotatable support 16 is rotatably mounted on a lower portion of central shaft 14. Rotatable support 16 carries bucks 4 for rotation therewith through the cycle of stations 6, 8, 10. Rotatable support 16 is rotatable about an axis of rotation by shaft 14 and may be of any appropriate design to carry the appropriate number of bucks 4 from station to station.

An independently rotatable indexing device 18 is also mounted on central shaft 14 below rotatable support 16. Indexing device 18 may also be of any appropriate design. In the preferred embodiment shown, indexing device 18 comprises an annular table with a first indexing arm 20 and a second indexing arm 22 extending radially outwardly therefrom, and is mounted for rotation concentrically about the same axis of rotation as the support 16.

As shown in FIGS. 2 and 4, an indexing actuator 24, for example an air actuator cylinder, is pivotably mounted on frame 12 at one end and rotatably connected to first indexing arm 20 of indexing device 18 at the other end. Movement of indexing actuator 24 is controlled via a control box 26 which contains hydraulic, pneumatic and electrical controls of the type readily known to those skilled in the art. Attached to indexing actuator 24 is a return spring 28 which is also attached to a portion of frame 12. When actuated, indexing actuator 24 moves from a first position as shown in FIG. 4 to a second position as shown in FIG. 2, passing through a dead center position whereat the actuator rod is aligned with axis of shaft 14. For example, piston action of indexing actuator 24 and compressed air may cause this movement. Return spring 28 assists with the movement of indexing actuator 24 from the second position to the first position. This is desired because indexing actuator 24 may not experience the momentum of rotatable support 16 and bucks 4 to carry it past a dead center position (cylinder aligned with shaft 14) when moving from the second position to the first position as it does when moving from the first position to the second position, as will become evident from the discussion hereinafter.

According to the preferred embodiment shown in detail in FIG. 6, an indexing pin 30 and an indexing pin actuator 32, for example an air cylinder, are mounted on first indexing arm 20 of indexing device 18. Indexing pin actuator 32 is controlled for example by pneumatic controls contained within control box 26. A plurality of indexing pin openings 34 are formed in rotatable support 16 corresponding to a station position of each of the plurality of bucks 4 supported thereon.

According to the preferred embodiment shown in FIGS. 2 and 4, an auxiliary actuator 36 is provided at the first position of indexing actuator 24 near the connection thereof with first indexing arm 20. Auxiliary cylinder 36 is arranged to properly position first indexing arm 20, and therefore indexing pin 30, beneath indexing pin opening 34 after actuator 24 has returned the indexing table 18 to its approximate starting position. Actually, actuator 24 initially locates the indexing arm 20 and the indexing pin 30 somewhat beyond the indexing pin opening 34 and then auxiliary actuator 36 is actuated via its control system in control box 26 to move the indexing arm 20 and indexing pin 30 in a reverse direction to a slight extent until the indexing pin lodges in the indexing pin opening 34. This avoids the need to program the motion of actuator 24 in a precise manner to locate indexing pin 30 exactly beneath the indexing pin opening 34 each return cycle. A combination of the actuator 24 and auxiliary actuator 36 accordingly achieves precise location of indexing pin 30 in an opening 34 in an efficient, inexpensive manner. This proper positioning of indexing pin 30 requires only a small adjustment. Auxiliary actuator 36 may include one or more known type limit switches 38 for the control thereof.

Indexing device 18, first indexing arm 20, indexing actuator 24, return spring 28, indexing pin 30, indexing pin actuator 32, indexing pin openings 34 and auxiliary actuator 36 form a preferred embodiment of an indexing mechanism for the automatic shirt pressing apparatus 2. However, various mechanical modifications to the indexing mechanism are possible while retaining its function within the scope of the invention.

Figure 7:
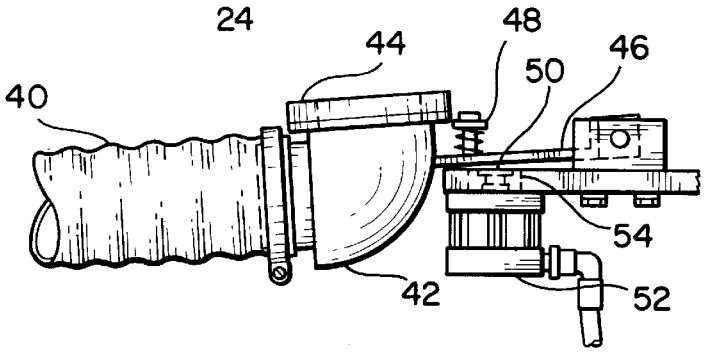
FIG. 7 is a partial view of a vacuum supply tube, etc. as seen from section line 7—7 in FIG. 4.

According to the preferred embodiment shown, a vacuum supply tube 40 located beneath support 16 and device 18 is connected to second indexing arm 22 of indexing device 18 for intermittent cyclic rotary motion therewith. As shown, vacuum supply tube 40 may include a vacuum elbow 42 and an elastomeric seal 44 at the free end thereof. Vacuum supply tube 40 may be connected to second indexing arm 22 by a lever arm 46 which is pivotably mounted to second indexing arm 22. A biasing element or lever arm spring 48 keeps lever arm 46, and thus vacuum supply tube 40, normally in a lowered position as shown in FIG. 7.

A lifting pin 50 and a corresponding lifting pin actuator 52, which may be pneumatically or electrically actuated, are preferably mounted to second indexing arm 22 with lifting pin 50 disposed in a lifting pin hole 54 formed therein. Lifting pin actuator 52 upon activation moves lifting pin 50 to press upwardly against lever arm 46 in a direction opposite the action of lever arm spring 48 to move vacuum supply tube 40 into a raised position. Lifting pin actuator 52 is controlled via appropriate controls located in control box 26.

According to the preferred embodiment shown, rotatable support 16 includes a buck side bag pressurized air connection 56 and a buck vacuum negative pressure connection 58 for each buck 4. A vacuum air connection tube 60 is connected to vacuum air connection 58 for communication with buck 4. A side bag air connection tube, not shown for clarity's sake, is connected to side bag air connection 56 for communication with buck 4 as well. Opposite the side bag air connection tube, an air supply tube, not shown, is connected to side bag air connection 56. The pressurized air and vacuum may be supplied by one or more appropriate pumps or blowers, not shown.

Figure 8A:
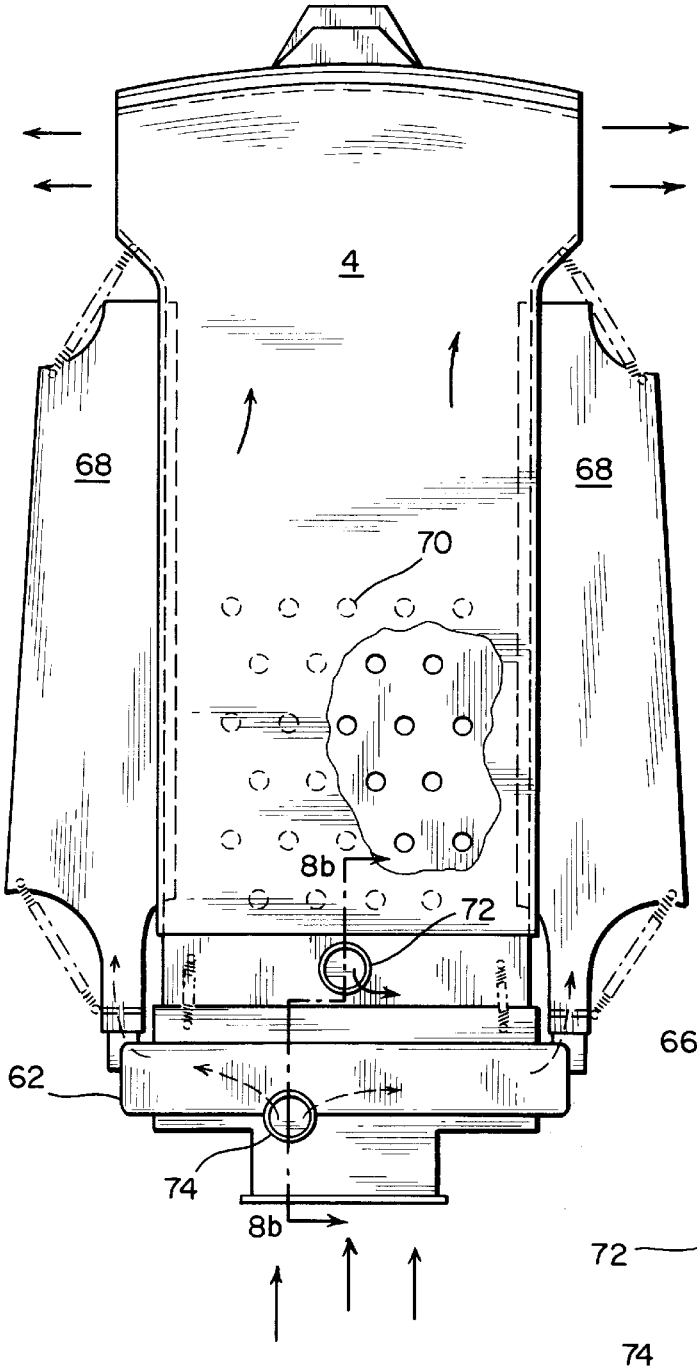
Figure 8B:
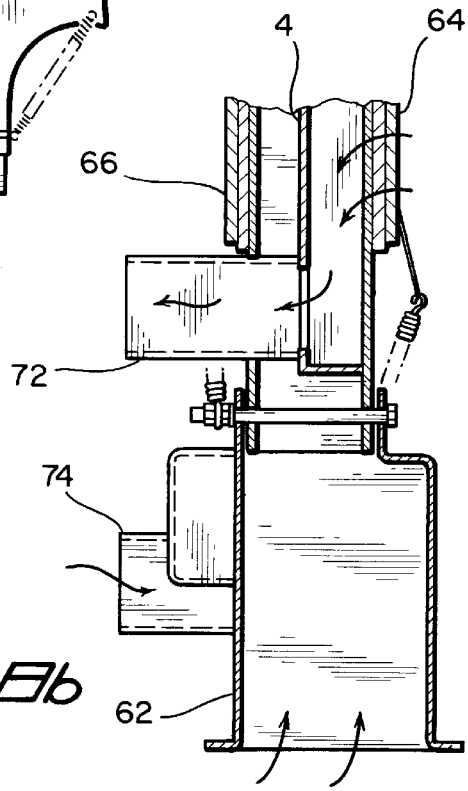

A preferred embodiment of pressing buck 4 is shown in FIGS. 8*a* and 8*b*. Buck 4 preferably includes a hollow base 62, a front side 64, a back side 66 and expandable side bags 68. Each buck 4 also includes a buck vacuum arrangement which, according to the preferred embodiment shown, comprises a plurality of air holes in front side 64 of buck 4 which are in communication with a vacuum supply port 72 located along backside 66. Vacuum supply port 72 is connected to vacuum air connection tube 60 and is in communication therewith. An air supply port 74 is also provided in base 62 along backside 66 of buck 4. Air supply port 74 is connected to the side bag air connection tube, not shown.

Automatic shirt pressing apparatus 2 includes a vacuum supply comprising a pressure blower 76, a damper box 78 and an extension tube 80. Automatic shirt pressing apparatus 2 also includes a pressurized air supply which is not shown, but which is conventional.

The operation of automatic shirt pressing apparatus 2 including the indexing mechanism and the buck vacuum arrangement is as follows.

A shirt to be pressed is dressed or loaded on a respective buck 4 at loading station 6 in a well-known manner. Vacuum supply tube 40 is located in its first position beneath the respective buck 4 at loading station 6, as shown in FIG. 4. Lifting pin actuator 52 is activated to actuate lifting pin 50 to press against lever arm 46 overcoming the resilient downward force of lever arm spring 48 to lift vacuum elbow 42 and vacuum supply tube 40 into a raised position. In its raised position, vacuum supply tube 40 is connected to and brought into communication with vacuum air connection 58 via vacuum elbow 42. Seal 44 helps to ensure that a proper vacuum connection is maintained. This actuator arrangement constitutes a vacuum connector device for enabling connection and disconnection between the vacuum supply tube 40 and successive bucks located at the loading and pressing stations.

Vacuum supply tube 40 thus supplies a vacuum negative pressure from the vacuum supply to a respective buck 4 via vacuum air connection tube 60 and vacuum supply port 72. The vacuum negative pressure supplied to the respective buck 4 causes the front tail of the shirt to be continuously and uninterruptedly held against front side 64 due to air holes 70.

Simultaneously, indexing actuator 24 is in its first position as shown in FIG. 4. Indexing pin actuator 32 is controlled to actuate indexing pin 30 to extend into an indexing pin opening 34 in rotatable support 16. Thus, a connection is formed between indexing device 18 and rotatable support 16 by indexing pin 30 and indexing pin opening 34 with indexing arm 20 at its first position.

Indexing actuator 24 is then actuated to move from its first position to its second position as shown in FIG. 2. Thus, indexing device 18 is rotated by indexing actuator 24 into its second position in which first indexing arm 20 is located at its second position at pressing station 8. Because of the connection between indexing device 18 and rotatable support 16 formed by indexing pin 30 and indexing pin opening 34, rotatable support 16 is moved along with indexing device 18 such that the respective buck 4 is transported from loading station 6 to pressing station 8.

Since vacuum supply tube 40 is connected to second indexing arm 22 of indexing device 18, vacuum supply tube 40 moves along with indexing device 18, rotatable support 16 and buck 4 into its second position at pressing station 8 as shown in FIG. 2. During this movement from loading station 6 to pressing station 8, vacuum elbow 42 maintains its connection to vacuum air connection 58 and the vacuum negative pressure supplied to the respective buck 4 is maintained continuously and uninterruptedly. Thus, the front tail of the shirt to be pressed is held against front side 64 of the respective buck 4 during this entire movement.

Once the respective buck 4 arrives at pressing station 8 a pressing operation is begun by moving pressing plates inwardly into engagement with the shirt front and back while air pressure is supplied to expandable side bags 68 of the buck to ensure proper pressing of the shirt in accordance with known principles. Once the pressing operation is initiated, the vacuum negative pressure supplied by the vacuum tube may be released since the shirt front being pressed no longer needs to be held against the respective buck 4.

Therefore, once the pressing operation has commenced, lifting pin actuator 52 is controlled to withdraw lifting pin 50 from pressing against lever arm 46. Lever arm spring 48 thus forces lever arm 46 downward causing vacuum elbow 42 to be disconnected from vacuum air connection 58. Vacuum supply tube 40 is thus moved into its lowered position out of communication with the buck vacuum arrangement of the respective buck 4. The vacuum negative pressure may be interrupted in tube 40 when it is so disconnected.

Indexing actuator 24, with the aid of return spring 28, is then returned to its first position at unloading station 10 as shown in FIG. 4. Indexing device 18 connected thereto also rotates back to its first position with first indexing arm 20 at unloading station 10 and second indexing arm 22 at loading station 6. However, prior to the return of indexing actuator 24 to its first position, indexing pin actuator 32 is controlled to withdraw indexing pin 30 from indexing pin hole 34 to break the connection between indexing device 18 and rotatable support 16. Thus, rotatable support 16 does not rotate in a reverse direction with indexing device 18 during this movement.

When indexing actuator 24 returns to its first position as shown in FIG. 4, indexing pin 30 may need to be more accurately aligned with a subsequent indexing pin opening 34 now located at unloading station 10. As described above, auxiliary actuator 36 controlled by limit switches 38 is used to adjust the final position of first indexing arm 20 and accordingly indexing pin 30 so that it is aligned with an indexing opening 34.

Upon the return of indexing actuator 24 and vacuum supply tube 40 to their first position at the loading station as shown in FIG. 4, another shirt to be pressed will have been loaded on a subsequent buck 4 now located at loading station 6 and the cycle is repeated. Thus, the operation of automatic shirt pressing apparatus 2 may be realized continuously with shirts being transported cyclically through the sequences of stations 6, 8, 10.

The present invention is by no means limited to the above-described embodiments represented in the accompanying drawings; on the contrary, such an automatic shirt pressing apparatus and corresponding method may be realized in all sorts of variants while still remaining within the scope of the invention. For example, while the invention is useful with a three buck arrangement moveable between loading, pressing and unloading stations, the arrangement could be used with a double buck system moving between a loading and a pressing station.

The specific mechanical details constituting the indexing device, the indexing pin and indexing pin openings, and the various actuators could be varied in accordance with the knowledge of a person skilled in the art in a manner that will achieve the same function of these elements. Thus, while an actuating air cylinder may be described in connection with the preferred embodiment, it should be understood that various other type of actuators, including mechanical and electrical actuators, could be utilized instead. The mechanical arrangement whereby the vacuum supply tube 40 is pivotally mounted on the indexing device may be varied in a manner to achieve the same function using different mechanical elements and actuator arrangements without departing from the scope of the invention. While the vacuum tube is mounted so as to be rotatable with the rotatable buck support, it will be understood that, where the bucks are moved linearly or along a different geometric path, the support arrangement for the vacuum tube can be adapted to follow the path of a buck moving between a loading station and a pressing station with appropriate actuators to connect and disconnect the vacuum tube to and from successive bucks located at the loading and pressing stations. Accordingly, the scope of the following claims is intended to encompass the broadest aspects of the invention without limitation imposed by the description of a preferred embodiment provided herein.

I claim:

1. An automatic shirt pressing apparatus having at least a loading station and a pressing station, comprising:

a plurality of pressing bucks mounted for movement at least between a loading and a pressing station;

a buck vacuum arrangement associated with each of said bucks; and a vacuum supply tube including a vacuum connector device for enabling connection of said vacuum supply tube to said buck vacuum arrangement of a buck located at the loading station, said vacuum supply tube arranged so as to be movable with said buck from a loading station to a pressing station while remaining connected thereto and said vacuum connector device including a device for enabling said vacuum supply tube to be disconnected from said buck vacuum arrangement upon initiation of a pressing operation at said pressing station using said buck.

2. The shirt pressing apparatus according to claim 1, further comprising:

an indexing device to which said vacuum supply tube is connected for movement therewith, said indexing device being mounted for movement with each of said buck vacuum arrangements from said loading station to said pressing station and back to said loading station independently of a buck vacuum arrangement; and an actuator for moving said indexing device and vacuum supply tube between said loading and pressing stations separately from said buck vacuum arrangement.

3. The shirt pressing apparatus according to claim 2, wherein said vacuum supply tube is connected to said indexing device by a lever arm which is pivotably mounted to the indexing device.

4. The shirt pressing apparatus according to claim 3, further comprising:

a biasing element which resiliently biases said lever arm such that said vacuum supply tube is normally in a first position disengaged from any buck vacuum arrangement;

an actuator which when actuated pushes against said lever arm opposite said biasing element such that said vacuum supply tube is moved to second position; and an actuator arranged to actuate said lever arm to move said lever arm between said first and second positions; and wherein said first position of said lever arm and vacuum supply tube corresponds to a position at which said vacuum supply tube is connected to a buck vacuum arrangement of a buck and said second position of said vacuum supply tube corresponds to a position at which said vacuum supply tube is disconnected from the buck vacuum arrangement of any of the bucks.

5. The shirt pressing apparatus according to claim 1, further comprising:

said bucks mounted on a movable support movable between said loading and pressing stations;

an indexing device mounted adjacent said movable support for independent indexing motion, said indexing device being movable between a first position and a second position;

an indexing mechanism connected to said indexing device, said indexing mechanism being engageable with said movable support for indexing said support between said first and second positions;

said vacuum supply tube being connected to said indexing device for movement therewith; and said first and second positions corresponding to positions where said vacuum connection device is located at the loading and pressing stations, respectively.

6. The shirt pressing apparatus according to claim 5, wherein said vacuum supply tube is movably connected to said indexing device; and said vacuum connector device is arranged to move said vacuum supply tube relative to said indexing device to thereby engage and disengage the vacuum supply tube with a buck vacuum arrangement.

7. The shirt pressing apparatus according to claim 6, further comprising:

said vacuum connector device compressing a pivoted lever;

a biasing element which resiliently biases said lever such that said vacuum supply tube is normally in a first position disengaged from any buck vacuum arrangement;

an actuator pin which when actuated pushes against said lever opposite said biasing element such that said vacuum supply tube is moved to a second position; and an actuating cylinder arranged to actuate said lever to move said lever between said first and second positions; and wherein said first position of said lever and said vacuum supply tube corresponds to a position at which said vacuum supply tube is connected to a buck vacuum arrangement of a buck and said second position of said vacuum supply tube corresponds to a position at which said vacuum supply tube is disconnected from the buck vacuum arrangement of any buck.

8. The shirt pressing apparatus according to claim 5, wherein said indexing mechanism comprises:

said movable support and indexing device mounted for rotational motion about a common rotation axis;

a plurality of indexing pin receiving openings in said movable support;

an indexing pin mounted on said indexing device, said indexing pin being engageable with said indexing pin receiving openings;

an indexing pin actuator mounted on said indexing device, said indexing pin actuator arranged to move said indexing pin into engagement with an indexing pin receiving opening;

said first and second positions constituting rotational positions of said support and indexing device; and an indexing actuator connected to said indexing device, said indexing actuator being movable between said first and second positions to move said indexing device and said movable support therewith from said first position to said second position via an index pin engaged with one of said indexing pin receiving openings, and to return the indexing device to at least approximately said first position.

9. The shirt pressing apparatus according to claim 8, further comprising:

an auxiliary actuator arranged to move said indexing pin relative to one of said indexing pin openings when said indexing device is first returned to approximately said first position by said indexing actuator.

10. A shirt pressing apparatus according claim 2, wherein said bucks are mounted on a movable support movable between said loading and pressing stations, wherein said movable support and indexing device are mounted for rotation about a common rotation axis, the movement of said movable support and indexing device comprising rotary motion about said rotation axis.

11. A method of pressing a shirt using an automatic shirt pressing apparatus having a plurality of bucks mounted on at least one movable support which is moved to transport the bucks through a cycle of stations including at least a loading station and a pressing station, each of the bucks including a vacuum arrangement for holding at least a front tail of a shirt against a respective buck, the method comprising the steps of:

dressing a shirt on a respective buck located at a loading station;

supplying a vacuum negative pressure to a vacuum arrangement of the respective buck located at the loading station to hold at least a front tail of the shirt against the respective buck;

maintaining the vacuum negative pressure supplied to the vacuum arrangement of the respective buck continuously and uninterruptedly while moving the respective buck from the loading station to a pressing station and until initiation of a pressing operation in the pressing station;

initiating pressing of the shirt against the respective buck in the pressing station; and releasing the vacuum negative pressure supplied to the vacuum arrangement of the respective buck upon initiation of the pressing of the shirt in the pressing station.

12. A method of pressing a shirt using an automatic pressing apparatus having a plurality of bucks mounted on at least one movable support which is moved to transport the bucks through a cycle of stations including at least a loading station and a pressing station, each of the bucks including a vacuum arrangement for holding at least a front tail of a shirt against a respective buck, the apparatus including a vacuum supply tube, the method comprising the steps of:

dressing a shirt on a respective buck located at a loading station;

connecting a vacuum supply tube to a vacuum arrangement of the respective buck located at the loading station to supply a vacuum negative pressure to hold at least a front tail of the shirt against the respective buck;

moving both the respective buck and the vacuum supply tube in connected relationship with the buck from the loading station to the pressing station until a pressing procedure is initiated in the pressing station while continuously and uninterruptedly maintaining the supply of the vacuum negative pressure to the buck vacuum arrangement;

initiating pressing of the shirt against the respective buck; and disconnecting the vacuum supply tube from the respective buck to release the vacuum negative pressure supplied to the respective buck upon initiation of the pressing of the shirt.

13. The method according to claim 12, further comprising the step of:

after disconnecting the vacuum supply tube, returning the vacuum supply tube to the loading position at a position whereat it may be connected to the vacuum arrangement of a following buck located at the loading station independently of the buck located at the pressing station.

* * * * *